US005638572A

United States Patent [19]

Canni Ferrari

[11] Patent Number: 5,638,572

[45] Date of Patent: Jun. 17, 1997

[54] ELECTRIC BROOM

[75] Inventor: Cesare Mario Canni Ferrari, Cassina de' Pecchi, Italy

[73] Assignee: Brain Wave S.r.l., Cassina de' Pecchi, Italy

[21] Appl. No.: 586,727

[22] PCT Filed: Jan. 24, 1995

[86] PCT No.: PCT/IT95/00005

§ 371 Date: Jan. 22, 1996

§ 102(e) Date: Jan. 22, 1996

[87] PCT Pub. No.: WO96/22725

PCT Pub. Date: Aug. 1, 1996

[51] Int. Cl.[6] ..... A47L 5/28

[52] U.S. Cl. ..... 15/323; 15/344; 15/350; 15/393

[58] Field of Search ..... 15/344, 350, 398, 15/393, 323

[56] References Cited

U.S. PATENT DOCUMENTS

| | | | |
|---|---|---|---|
| 993,772 | 5/1911 | Goughnour | 15/393 |
| 3,934,302 | 1/1976 | Mabuchi | 15/398 X |
| 4,573,234 | 3/1986 | Kochte et al. . | |
| 4,665,582 | 5/1987 | Richmond et al. | 15/344 |
| 4,766,638 | 8/1988 | McDowell . | |
| 4,934,020 | 6/1990 | Jackson | 15/344 X |
| 4,956,892 | 9/1990 | Fawkes . | |
| 5,099,545 | 3/1992 | Krasznai | 15/344 |
| 5,432,976 | 7/1995 | Alazet | 15/398 X |
| 5,440,782 | 8/1995 | Yamashita | 15/398 |

FOREIGN PATENT DOCUMENTS

| | | | |
|---|---|---|---|
| 0192624 | 8/1986 | European Pat. Off. . | |
| 0605280 | 7/1994 | European Pat. Off. . | |
| 0611544 | 8/1994 | European Pat. Off. . | |
| 2213758 | 8/1974 | France . | |
| 3143355 | 5/1983 | Germany | 15/393 |

*Primary Examiner*—Chris K. Moore
*Attorney, Agent, or Firm*—Rothwell, Figg, Ernst, Kurz

[57] ABSTRACT

The broom comprises a handle in the form of an elongated stick, a broom body fixed below to the handle, cleaning means born by the broom body and designed to collect dirt on a floor after dragging of the broom body on said floor. It is characterized in that it comprises a vacuum cleaner unit housed in the broom body provided with a suction mouth open at the bottom in a position adjacent to the cleaning means.

17 Claims, 4 Drawing Sheets

ELECTRIC BROOM

FIELD OF THE INVENTION

The present invention relates to an electric broom for household use.

PRIOR ART

Electrical apparatuses commonly denominated electric brooms which are in practice vacuum cleaners with a particular sucking head designed for sucking dust from the floor are known. For example, apparatuses of this kind are described by EP-A-0192624, EP-A-0611544, FR-A-2213758, U.S. Pat. No. 4,766,638 and U.S. Pat. No. 4,956,892. Said sucking head normally comprises a boxed body provided with a sucking mouth surrounded by brushes of various shapes and is connected in a jointed manner to an elongated handle. In use the head is passed over the floor so as to permit the suction mouth to suck in the dirt spread on the floor. The jointed connected allows that the sucking head remains horizontal on the floor, irrespective of the inclination of the handle, thereby ensuring the desired suction effect. The actual vacuum cleaner unit can be housed in a separate truck connected at the head by a suction tube constituting the above mentioned elongated handle or it can be mounted directly on the handle and optionally on the sucking head itself.

These apparatuses serve certainly for cleaning the floor but despite their name of electric broom they are not used for sweeping. None of them is capable of performing the typical action of a broom which is to collect, move and accumulate the dirt on the floor. Consequently the manner of using said apparatuses is significantly different from the manner of using a broom.

Summing up, the availability of one of the apparatuses commonly called electric brooms does not allow doing without a conventional broom.

In the following, the term "broom" will be used in strict sense, i.e., only for devices or apparatuses that include a stick handle fixed to a body provided with cleaning means such as bristles or the like, all these elements being arranged in such a manner as to allow that the broom is used for sweeping.

The only known electric broom in this sense is described in EP-A-0605280. It has a handle rigidly fixed to a broom body provided with cleaning bristles. An electric vacuum cleaner unit, housed in the broom body, is provided with a suction mouth open in an upper corner region of the broom body. Operation of this electric broom is split into two phases: in the first phase, the broom is used to sweep as a normal broom to gather dust on a floor; in the second phase, the electric vacuum cleaner is activated, while the broom body is inclined and used as a normal vacuum cleaner to such the gathered dust from the floor. It is impossible to have a suction action while sweeping.

SUMMARY OF THE INVENTION

The idea underlying the present invention is to conceive an apparatus permitting both sweeping in the conventional manner and collection of the dirt by vacuum successively or simultaneously at choice.

On the basis of said idea the present invention relates to a broom comprising a handle in the form of an elongated stick, a broom body rigidly fixed below to the handle and cleaning means born by the broom body and designed to collect dirt on a floor after dragging the broom body over said floor, and a vacuum cleaner unit housed in the broom body and provided with a suction mouth open below in a position adjacent to the cleaning means.

An apparatus of this type is clearly a broom and as such can be used for collecting the dirt on the floor without operation of the vacuum cleaner unit. Dirt collected by the broom operated when the vacuum cleaner is turned off can always be removed in the conventional manner (with a dust pan) or it can be sucked up by operating the vacuum cleaner unit, only for the time strictly necessary. In addition to the obvious energy saving there is secured a drastic reduction in acoustic pollution. However, if preferred, the vacuum cleaner can be kept on while sweeping, thus allowing immediate and continuous suction of the dirt.

In general the brushing means can be of different types either with bristles or with elastic material. Preferably however the cleaning means comprise an elastic pad provided with at least one rectilinear cleaning lip.

Indeed, the presence of bristles would make the sucking action less effective because of the passage of air between the bristles.

Preferably the pad has an elongated form and is provided with two parallel cleaning lips and still more preferably the suction mouth is open in an intermediate position between the two lips. The presence of the two lip allows sweeping in a fully natural manner since it is possible to incline the broom on one side or the other freely. In addition, between the two lips is created a compact and particularly effective suction zone.

Advantageously the two cleaning lips are defined each by two surfaces of the pad mutually inclined at an angle $\alpha$ and filleted with a curvature radius r, with $\alpha$ between 60° and 90° and r between 2 mm and 10 mm. These values have proven suitable for allowing an effective cleaning action and adequate duration of the pad.

Advantageously the vacuum cleaner unit comprises an electric motor housed in the broom body, a suction fan mounted in the broom body and driven by the motor, a suction path in the broom body between the suction mouth and the fan, a filtering element in the suction path and a collection tank made in the broom body beside the suction path.

Such an arrangement permits handling the broom in accordance with the present invention as though it were a normal broom since the weights and space occupied are distributed in an analogous manner with a lower broom body and a simple upper stick handle.

Advantageously the broom body comprises two units, one upper unit fixed to the handle and provided with the motor and fan, and a lower unit bearing the cleaning means and comprising the collection tank and the suction mouth, the two units being integrated in a removable manner by peripheral groove and tongue joint between the two units and by means of a plurality of hooking means. The embodiment in two parts allows making readily accessible the collection tank for emptying the dirt while the integration by means of groove and tongue joint and hooking ensures the necessary solidity for use as a broom.

The groove and tongue joint can be provided in various ways. Preferably the peripheral groove and tongue joint is provided between a male portion made on the upper unit and a female portion made on the lower unit. Said groove and tongue joint is readily provided and particularly convenient in use.

Advantageously the broom comprises a rechargeable battery housed in the broom body for supply of the electric motor. Battery supply permits the greatest freedom of use of the broom to increase its practicality.

Advantageously there can be provided a support for hanging the broom on a wall with said support including means for electrical connection of the rechargeable battery of the broom with a battery charger.

DESCRIPTION OF A PREFERRED EMBODIMENT OF THE INVENTION

Figure 1:
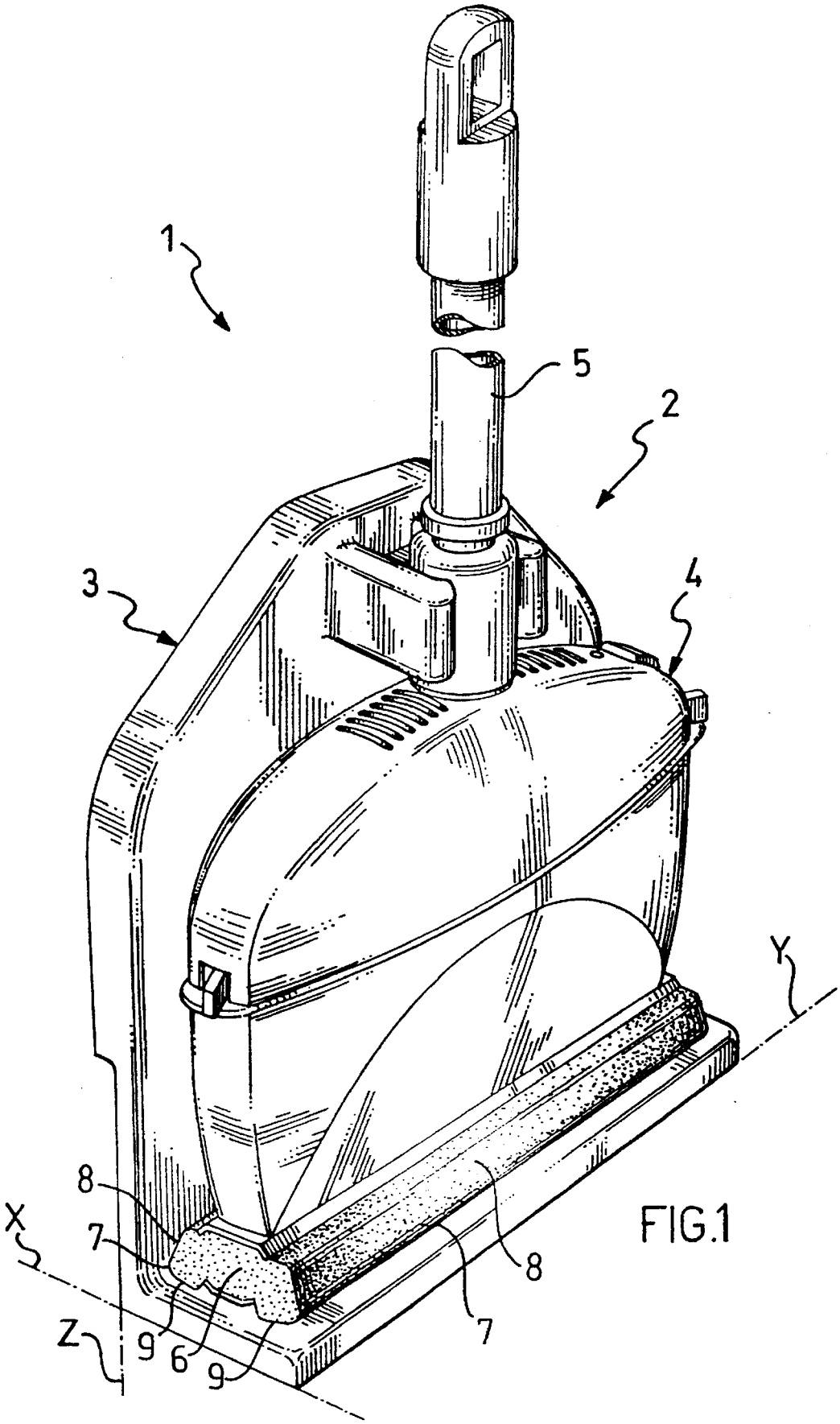
FIG. 1 shows a perspective view of a broom in accordance with the present invention mounted on a support.
Figure 2:
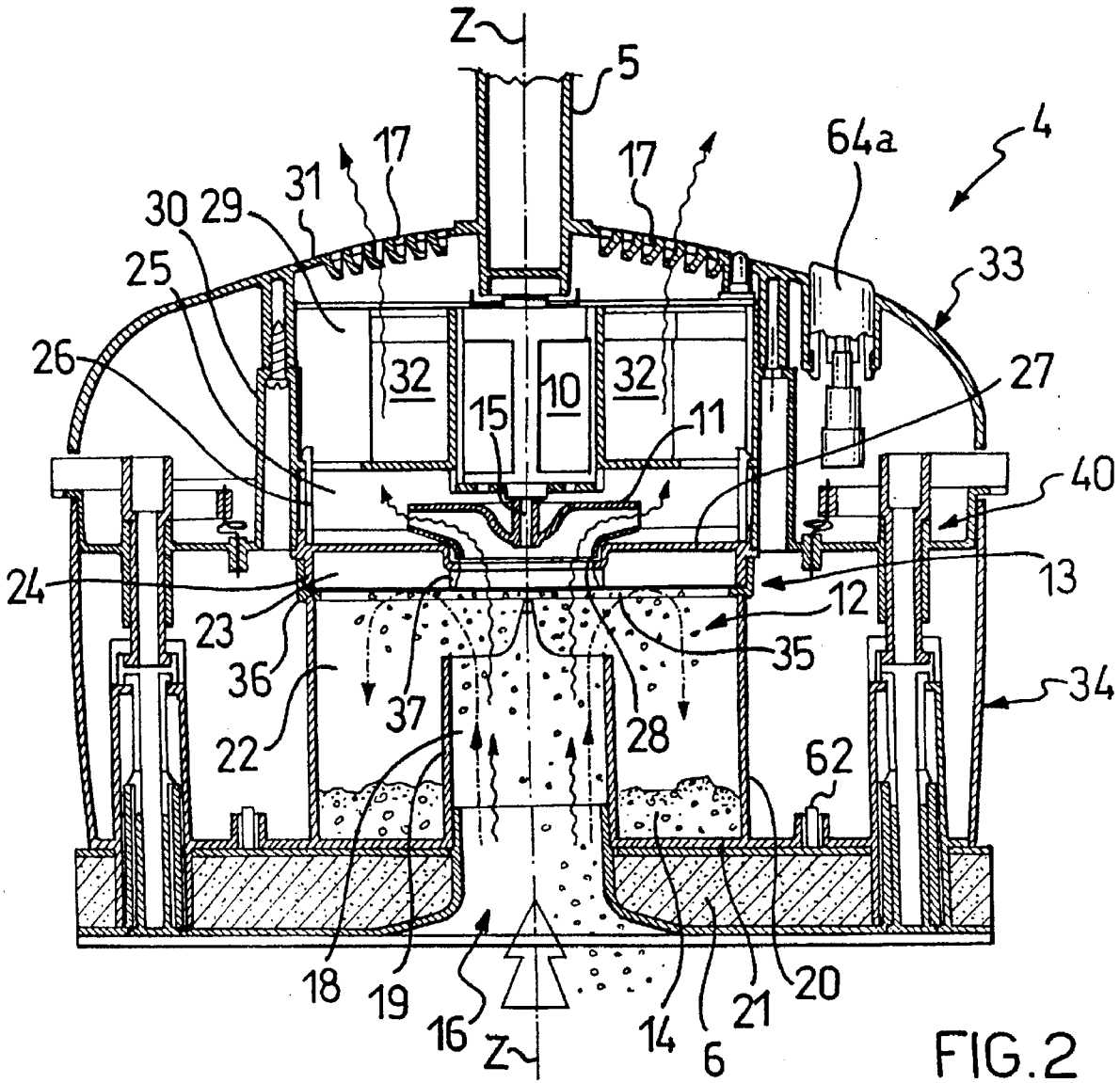
FIG. 2 shows a longitudinal cross section view of the broom of FIG. 1.
Figure 3:
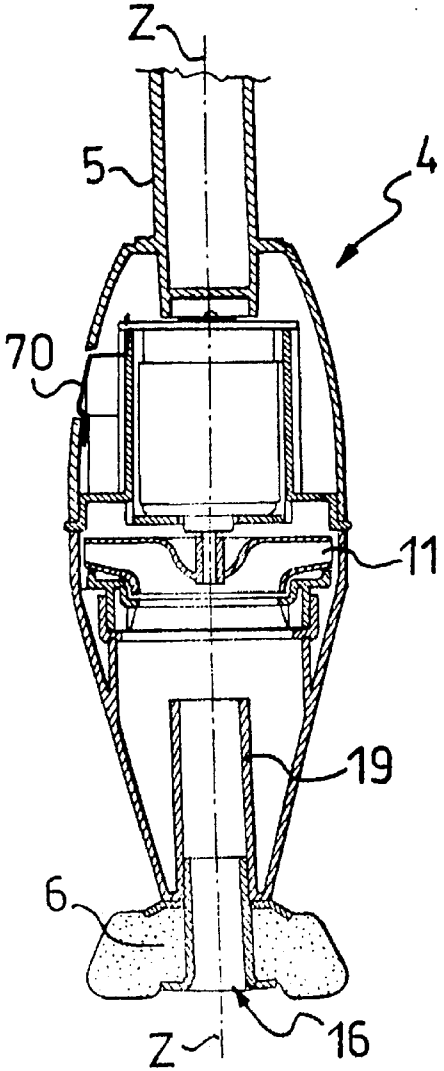
FIG. 3 shows a cross section view of the broom of FIG. 1.
Figure 4:
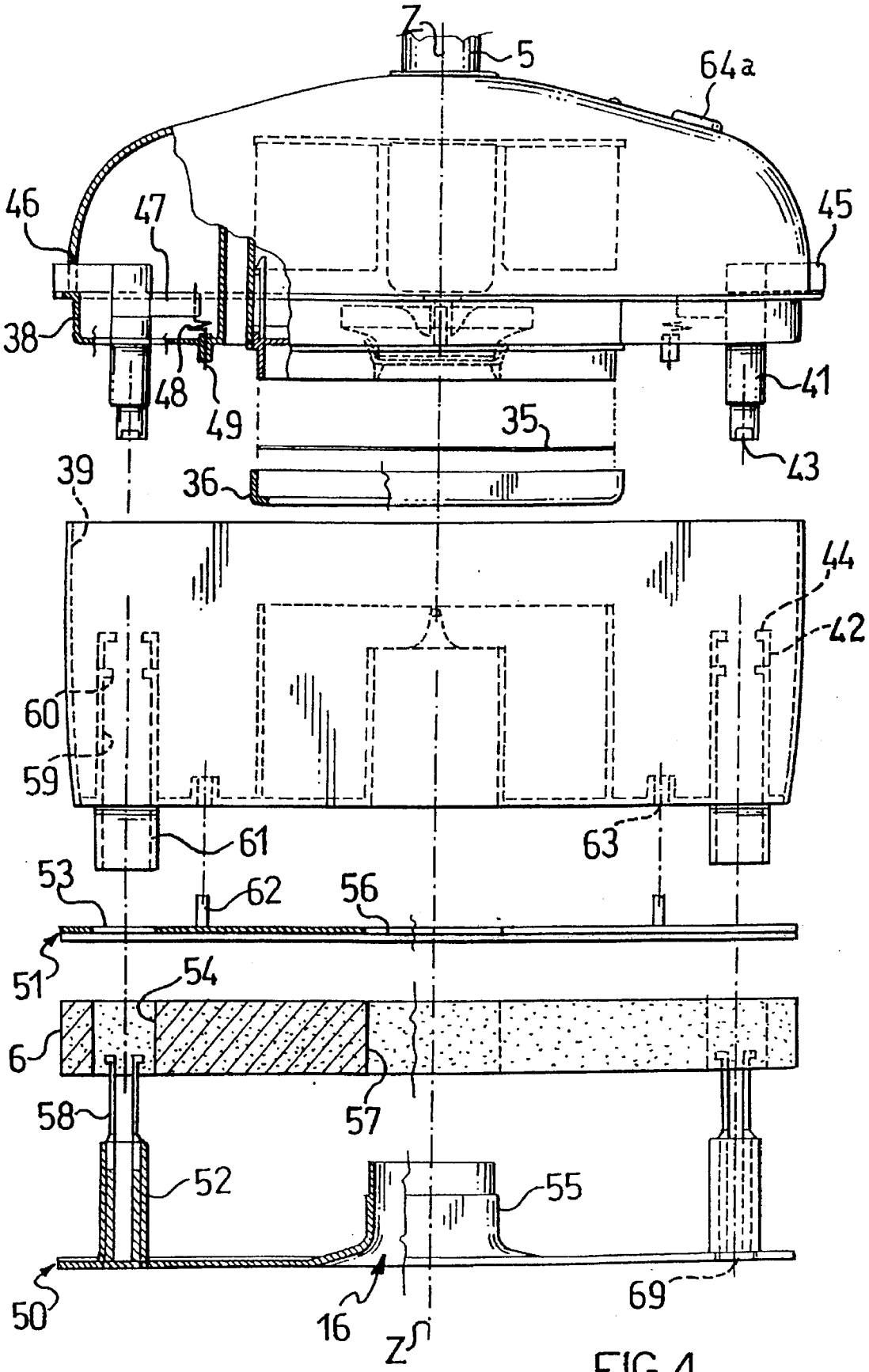
FIG. 4 shows an exploded longitudinal cross section view of the broom of FIG. 1.
Figure 5:
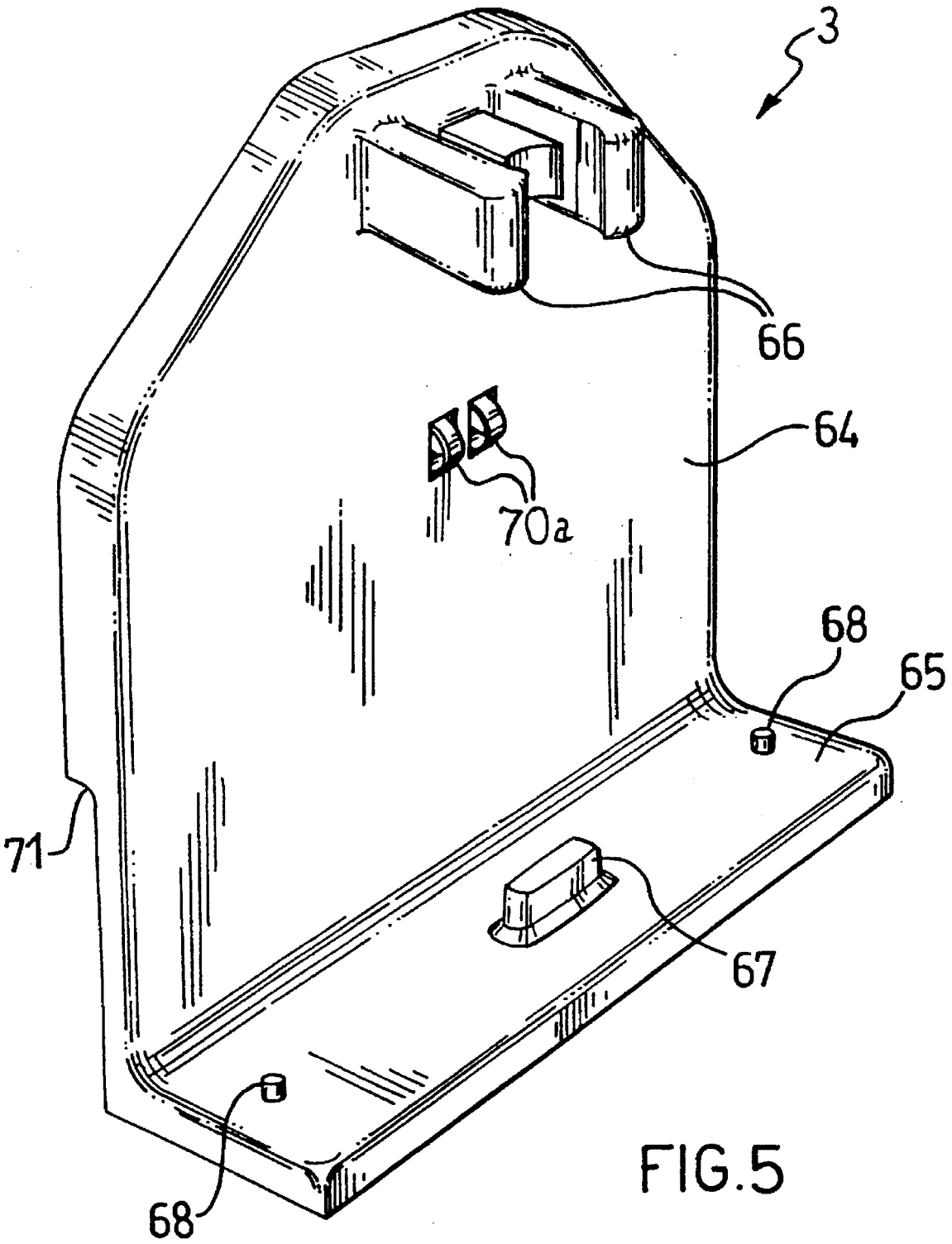
FIG. 5 shows a perspective view of the support for the broom of FIG. 1.

With reference to the figures reference number 1 indicates as a whole a broom assembly, including a broom 2 and a support 3.

The broom 2 comprises a broom body 4 rigidly fixed to the lower end of a handle 5 having the form of an elongated stick.

The broom body 4 has a form flattened vertically, i.e. it has a dimension in a horizontal direction X much smaller than both the dimension in the other horizontal direction Y perpendicular to the former and the dimension in a vertical direction Z. The broom body 4 is provided below with cleaning means and specifically a pad 6 of form elongated in direction Y provided in elastic material (foamed rubber or the like) and fitted with two parallel cleaning lips 7. The cleaning lips 7 are each defined by two surfaces of the pad 6, a side surface 8 and a bottom surface 9 which are mutually inclined at an angle $\alpha$ and filleted with a curvature radius r. Preferably $\alpha$ is between 60° and 90° while r is between 2 mm and 10 mm.

In the broom body is housed a vacuum cleaner unit comprising an electric motor 10, a fan 11, a suction path 12, a filtering element 13 and a collection tank 14. The electric motor 10 is mounted with the vertical motor axis 15 in centred position in the broom body 4 essentially aligned with the handle 5. The fan 11 is of the centrifugal type and keyed directly on the motor axis 15.

The suction path 12 is defined in the broom body 4 between a suction mouth 16 and a plurality of vent louvers 17. The suction mouth 16 is made in the bottom of the broom body 4 in a position adjacent to the cleaning means and traverses the pad 6 in a median position thereof between the two cleaning lips 7. The vent louvers 17 are made in the top of the broom body 4 in a position near the handle 5.

Between the suction mouth 16 and the vent louvers 17, the suction path 12 comprises a series of chambers open one on the other and closed towards the inner space of the broom body 4. A first chamber 18 defined by a first tubular wall 19 is adjacent to the suction mouth 16 and extends therefrom upward. A second tubular wall 20 surrounds coaxially the tubular wall 19. Below, said tubular wall 20 is closed by a bottom wall 21 of the broom body 4 and delimits the collection tank 14. Above, the tubular wall 20 extends vertically more than the tubular wall 19 and defines a second chamber 22 open at the top and on which opens the first chamber 18. A third chamber 23 is defined as an upward extension of the chamber 22 by a third tubular wall 24 and a fourth chamber 25 is defined as an upward extension of the chamber 23 by a fourth tubular wall 26. Between the second chamber 22 and the third chamber 23 is placed the filtering element 13 and between the third chamber 23 and the fourth chamber 25 is placed a baffle 27 having a circular central hole 28 in which is housed the fan 11. A fifth chamber 29 is defined as an upward extension of the chamber 25 from a fifth tubular wall 30 up to a top wall 31 of the broom body 4 where are made the vent louvers 17. In the chamber 29 are housed the electric motor 10 and a plurality of supply batteries 32 which are thus licked and surrounded by the air flow in the suction duct 12. All of the tubular walls 19, 20, 24, 26, 30 have a cross section which is not circular but elliptical or at least crushed in the direction of the axis X to make better use of the inner space of the broom body 4 which is flattened in the direction of the axis X.

The broom body 4 is provided in two separable superimposed units, a top unit 33 and a bottom unit 34 both having a boxed structure and provided preferably of moulded plastic. The top unit 33 comprises the suction path 12 defined by the chambers 23, 25, 29 while the bottom unit 34 comprises the portion of suction path 12 defined by the chambers 18 and 22. The electric motor 10, the fan 11 and the batteries 32 are thus housed in the top unit 33 which also bears the handle 5. The collection tank 14 is housed in the bottom unit 34 which also bears the pad 6. The filtering element 13 comprises a micropierced fabric 35 (provided preferably with a so-called nonwoven fabric) fixed on a ledge 36 of elastomeric material which is fitted on the tubular wall 24 and provides airproofness with the tubular wall 20 when the two units 33 and 34 are assembled. A plurality of spacing teeth 37 are fixed to the baffle 27 around its central hole 28 and turned downward against the filter fabric 35 to avoid the pressure exerted by the air crushing the fabric 35 against the fan 11 and thus reducing the filtering surface area.

The top unit 33 is provided below with a peripheral step 38 while the bottom unit 34 is open above and provided with a peripheral edge 39 essentially complementary to the step 38. The step 38 and the peripheral edge 39 constitute respectively a male portion and a female portion of a peripheral groove and tongue joint between the two units 33 and 34. In addition to said groove and tongue joint the two units 33 and 34 are provided with mutual connection means indicated as a whole by reference number 40.

The connection means 40 comprise a pair of shafts 41 pivotally mounted on the top unit 33 and protruding downward and a corresponding pair of seats 42 provided in the bottom unit 34 and turned upward. Each shaft 41 is provided below with at least one eccentric tooth 43 while each seat 42 is provided with a corresponding hooking edge 44 for the tooth 43. Each shaft 41 is then provided with a rotary drive lever 45 protruding outside the top unit 33 through a window 46 and an auxiliary lever 47 connected by a spring 48 to a fixed point 49 on the unit 33.

The pad 6 of elastic material is preferably mounted between two rigid supports, a lower support 50 and an upper support 51, which are mutually integral. Specifically the lower support 50 is provided with two posts 52 turned upward and which engage in corresponding holes 53 formed in the upper support 51 through passages 54 in the pad 6. In addition the lower support 50 is provided in a median position of an opening filleted to a tubular wall 55 extending upward and engaging in a corresponding hole 56 in the upper support 51 through a passage 57 in the pad 6. The tubular wall 55—with pad 6 mounted—connects to the first tubular wall 19 of the suction path 12. In practice the tubular wall 55 defines the suction mouth 16. For fixing of the broom body 4 the posts 52 are provided with elastic toothed appendices 58 turned upward for insertion in seats 59 formed in the bottom unit 34 and snap connection with teeth 60 in said seat. In this manner to the broom body 4 is fixed the lower support 50 and therewith the pad 6 and the upper support 51. To ensure the best mutual positioning the bottom unit 34 is provided around the seats 59 with respective tubular extensions 61 designed to enter the holes 53 and the passages 54 around the posts 52. In addition there are provided two rungs 62 projecting above from the upper support 51 and two corresponding holes 63 formed in the lower wall of the bottom unit 34 of the broom body 4.

The broom is also provided with a switch 64*a* housed on the top unit 33 for starting and stopping the electric motor 10.

The support 3 for the broom 2 comprises an essentially vertical wall 64 designed for fixing to a wall and an essentially horizontal bracket 65 which can be rested on the floor or hung depending on the height at which the support 3 is placed on the wall.

On the wall 64 are provided two opposed elastically deformable arms 66 for holding the handle 5 of the broom 2. On the bracket 65 is provided a positioning projection 67 designed to be inserted in the suction mouth 16. Two other smaller projections 68 are provided on the bracket 65 for insertion in holes 69 made in the lower support 50 of the pad 6 opposite the posts 52.

Between the support 3 and the broom 2 are provided electrical contacts for recharging the batteries 32. Specifically on the wall 64 of the support 3 are provided two contacts 70*a* and on the top unit 33 of the broom body 4 are provided two corresponding contacts 70. The contacts 70*a* and/or the contacts 70 are spring-mounted to permit effective electrical coupling. The contacts 70 are connected by wiring not illustrated with batteries 32. The contacts 70*a* are connected by wiring not illustrated with a battery charger or external power supply of the conventional type and not illustrated.

Behind the wall 64 is provided a step 71 to facilitate installation in the presence of a baseboard.

Operation of the broom in accordance with the present invention is clear from the above description.

With the electric motor 10 off, the broom 2 can be conveniently used as a normal broom. The cleaning lips 7 permit moving and collecting the dirt on a floor by operating the broom 2 in an absolutely normal manner.

Starting of the electric motor 10 causes a sucking action by the suction mouth 16. Said sucking action can be used either after collection of the dirt using the broom 2 manually as described above or during operation of the broom 2 to secure immediate suction of the dirt.

The air and dirt sucked in by the mouth 16 traverse the chamber 18 and enter the chamber 22 where they are intercepted by the filtering element 13. While the air can traverse said filtering element 13 the dirt is stopped and falls back into the collection tank 14. The air issues from the vent louvers 17 after traversing in succession the chambers 23, 25 and 29 and contributing to cooling of the electric motor 10 and the batteries 32.

To empty the collection tank 14 and optionally clean the filtering element 13 it is necessary to separate the two units 33 and 34. For this purpose one operates the lever 45 and rotates the shafts 41 to disengage the teeth 43 from the edge 44 of the seats 42. Subsequently one can draw out the top unit 33 from the bottom unit 34. The tank 14 can be readily emptied by merely overturning the bottom unit 34. The filter fabric 35 can be cleaned with a brush or the entire filtering element 13 can be removed and washed.

Also the cleaning pad 6 can be readily removed either for better cleaning thereof or for possible replacement. For this purpose it suffices to unhook the lower support 50 by means of mere traction since the coupling with the broom body 4 is by snap.

I claim:

1. The broom comprising a handle in the form of an elongated stick, a broom body fixed below to the handle, cleaning means born by the broom body rigidly and designed to collect dirt on a floor after dragging of the broom body on said floor, and a vacuum cleaner unit housed in the broom body provided with a suction mouth open at the bottom in a position adjacent to the cleaning means, said suction mouth adapted to functionally cooperate with said cleaning means while said cleaning means is in operative contact with said floor.

2. A broom, comprising:

a handle in the form of an elongated stick, a broom body fixed below to the handle, cleaning means born by the broom body rigidly and designed to collect dirt on a floor after dragging of the broom body on said floor, and a vacuum cleaner unit housed in the broom body provided with a suction mouth open at the bottom in a position adjacent to the cleaning means, wherein the cleaning means comprise a pad of elastic material provided with at least one rectilinear cleaning lip.

3. The broom in accordance with claim 2 wherein the pad has elongated form and is provided with two parallel cleaning lips.

4. The broom in accordance with claim 3 wherein the suction mouth opens in an intermediate position between the two cleaning lips.

5. The broom in accordance with claim 4 wherein the two cleaning lips are each defined by two pad surfaces mutually inclined at an angle $\alpha$ and filleted with a curvature radius r where $\alpha$ is between 60° and 90° and r is between 2 mm and 10 mm.

6. The broom in accordance with claim 1 wherein the vacuum cleaner unit comprises an electric motor housed in the broom body, a suction fan mounted in the broom body and operated by the motor, a suction path in the broom body between the suction mouth and the fan, a filtering element in the suction path and a collection tank made in the broom body beside the suction path.

7. The broom in accordance with claim 6 wherein the broom body comprises two units, an upper unit fixed to the handle and provided with the motor and fan and a lower unit bearing the cleaning means and comprising the collection tank and the suction mouth, the two units being integrated in a removable manner by means of a peripheral groove and tongue joint between the two units and by means of a plurality of hooking means.

8. The broom in accordance with claim 7 wherein the peripheral groove and tongue joint is provided between a male portion made on the upper unit and a female portion made on the lower unit.

9. The broom in accordance with claim 6 comprising a rechargeable battery housed in the broom body for supply of the electric motor.

10. The broom assembly comprising a broom in accordance with claim 6 and a support for hanging the broom on a wall with said support including means of electrical connection of the rechargeable battery of the broom to a battery charger.

11. A cordless battery operated broom, comprising:

a broom body which is elongated horizontally in a first direction and which has a substantially narrower width in a second horizontal direction perpendicular to said first direction;

an elongated handle attached to said broom body;

a first depending soft floor brushing means extending along a bottom of said broom body along substantially the entire length of said body in said first direction located proximate a first side edge of said bottom in said second horizontal direction;

a second depending soft floor brushing means extending along a bottom of said broom body along substantially the entire length of said body in said first direction located proximate a side edge opposite said first side edge of said bottom in said second horizontal direction, and spaced from said first floor brushing means;

said broom body including two separable units, an upper unit including a fan and a motor, and a lower unit removably connectable to said upper unit and including a collection tank and a suction mouth, said suction mouth having a central opening located in a central region between said first and second depending soft floor brushing means, said handle being fixed to said upper unit, and said broom body including a filter for preventing particles from entering said upper unit during operation of said broom;

whereby the broom can be used to brush the floor by sweeping the brushing means across a floor surface back and forth in a normal manner in said second horizontal direction, and said central opening can be used in conjunction with said sweeping of the brushing means to vacuum particles, said central opening being elongated in said first horizontal direction.

12. The broom of claim 11, wherein said brushing means are made of an elastic material.

13. The broom of claim 11, wherein said brushing means are rectilinear lips of an elastic pad.

14. The broom of claim 13, wherein said first and second brushing means include cleaning lips which extend outwardly from the sides of said broom body in said second horizontal direction.

15. The broom of claim 11, wherein said first and second brushing means include cleaning lips which extend outwardly from the sides of said broom body in said second horizontal direction.

16. The broom of claim 11, wherein said bottom of said broom body has a plate member attached thereto which has a passage extending upwardly from said central opening directly vertically into a filter, the upper end of said passage delineating a wall between the passage and said collection tank.

17. The broom of claim 1, wherein said cleaning means has a generally flat floor cleaning surface and said fan and said suction mouth are adapted to be able to vacuum dust on the floor when said flat floor cleaning surface rests on and parallel to said floor, said suction mouth being generally centrally located on a bottom of said broom body, such that a user can vacuum while continuing to sweep without having to interrupt the sweeping operation.

* * * * *